United States Patent [19]

Solberg

[11] Patent Number: 4,900,000

[45] Date of Patent: Feb. 13, 1990

[54] SUPPORT FOR MINATURE OBJECTS

[76] Inventor: Dean C. Solberg, 628 24th Ave., N.W., Minot, N. Dak. 58701

[21] Appl. No.: 240,094

[22] Filed: Sep. 1, 1988

[51] Int. Cl.[4] ..... B25B 1/00

[52] U.S. Cl. ..... 269/152; 269/211; 269/296

[58] Field of Search ..... 269/296, 211, 208, 152, 269/104

[56] References Cited

U.S. PATENT DOCUMENTS

| | | | |
|---|---|---|---|
| 519,016 | 5/1894 | Clairmont | 269/296 |
| 1,792,612 | 2/1931 | Staley | 269/296 |
| 2,429,109 | 10/1947 | Roach | 269/296 |
| 2,471,103 | 5/1949 | Franks et al. | 269/296 |
| 2,742,635 | 4/1956 | Capps | 269/296 |

FOREIGN PATENT DOCUMENTS

| | | | |
|---|---|---|---|
| 2102327 | 2/1983 | United Kingdom | 269/211 |

*Primary Examiner*—Robert C. Watson

*Attorney, Agent, or Firm*—Robert E. Kleve

[57] ABSTRACT

The invention comprises an adjustable support for support elongated miniature objects such as the fuselage or wing of an airplane or hull of a boat laterally of its length. The supports have their one ends attached to a horizontal surface, with the support each having a post fixed to their other end and a movable support having a post to be movable on the adjustable support to a position adjacent the lateral side of the miniature object opposite the fixed post to support the lateral sides of the object. A flexible string may be extended beneath the object and connected to the posts to support the bottom of the object in continuous close proximity.

4 Claims, 1 Drawing Sheet

FIG. 1
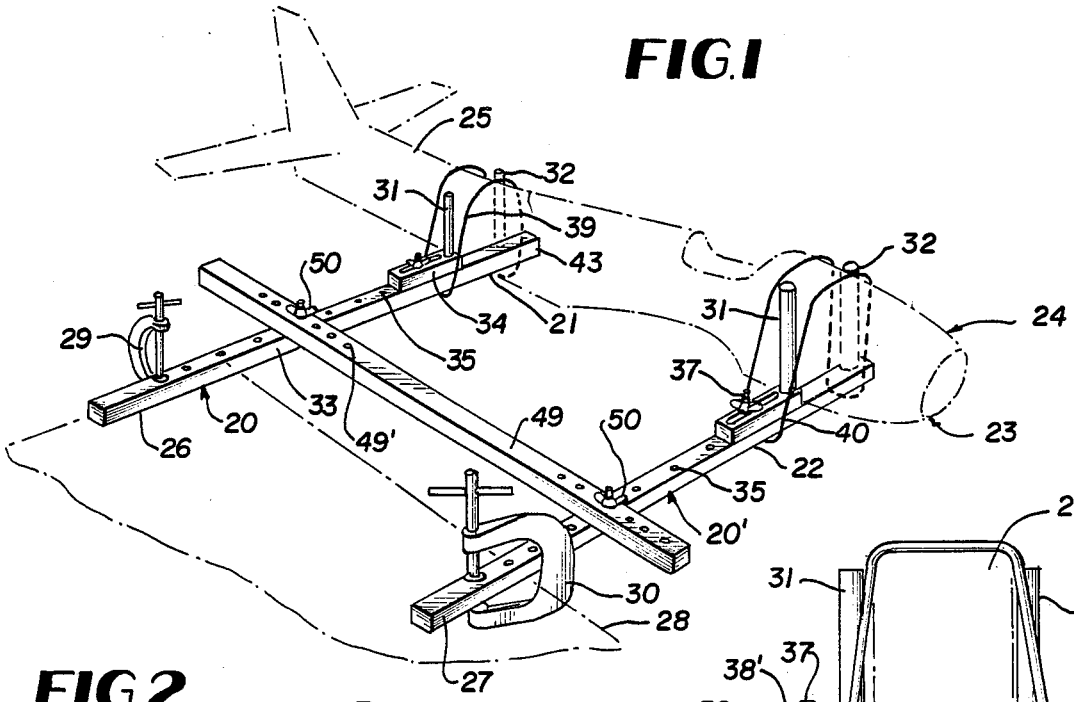
FIG. 2
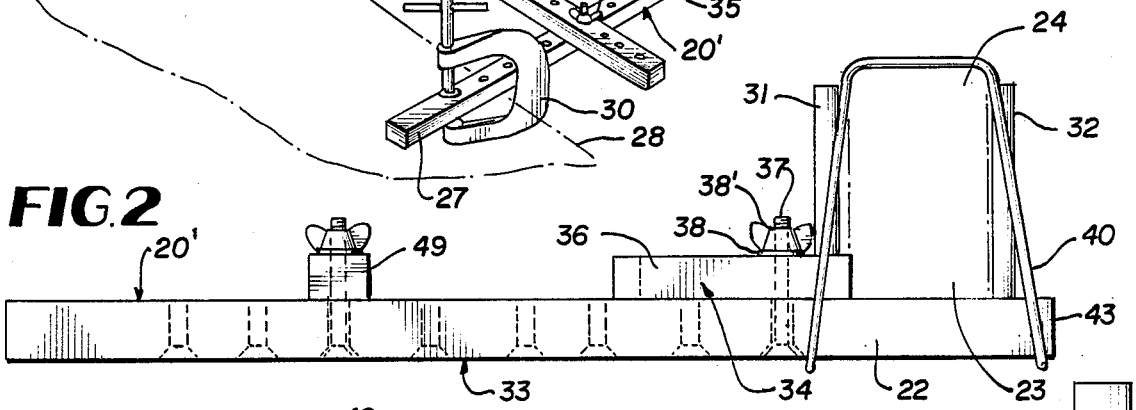
FIG. 3
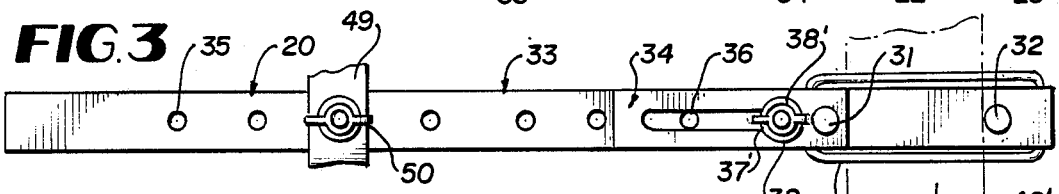
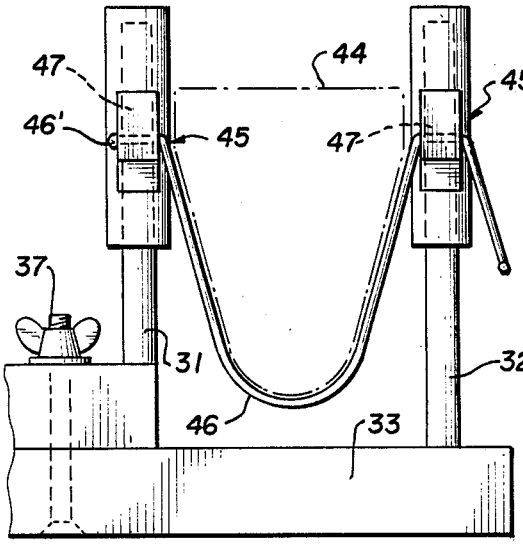
FIG. 4
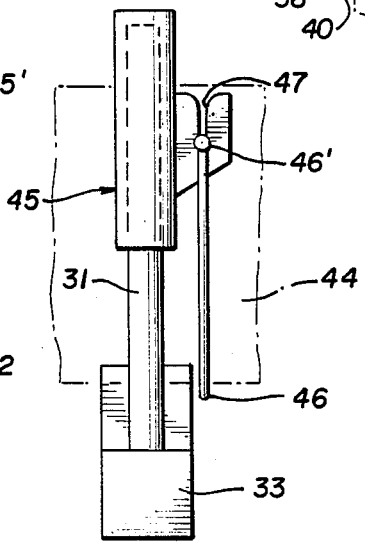
FIG. 5
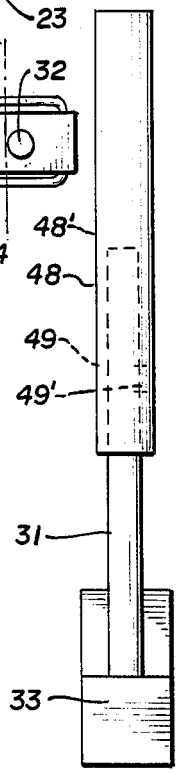
FIG. 6

SUPPORT FOR MINATURE OBJECTS

This invention relates to model supports for supporting minature objects, such as model airplanes, boats, and the like.

It is an object of the invention to provide a novel support apparatus for supporting minature objects such as a model airplane along front and rear portions of the airplane, laterally of its length at the edge of a surface to facilitate working upon the miniature object.

It is another object of the invention to provide a novel support apparatus for supporting the front and rear portions of a miniature object laterally of its front and rear to enable a person to perform work upon the object more easily.

It is another object of the invention to provide a novel support for supporting a model along portions of the model in a manner to enable a person to perform work upon the model while being supported.

Further objects and advantages of the invention will become apparent as the description proceeds and when taken in conjunction with the accompanying drawing wherein:

FIG. 1 is a perspective view of a pair of model supports having their one ends laterally supporting the front and rear portions of a model airplane with their rearward ends attached to the edge of a table.

FIG. 2 is an enlarged top view of one of the adjustable model supports.

FIG. 3 is an enlarged side view of one of the adjustable model supports.

FIG. 4 is a side view of a modified form of the invention wherein the poles of the adjustable supports have attachable sockets with a flexible string like object connected between two of the poles to provide a flexible support for the underside of a model.

FIG. 5 is a front view of the modified form wherein the attachable sockets have a string like object connecting the similar to FIG. 4.

FIG. 6 is a side elevational view of a attachment to the poles of the adjustable support having hollow socket like bottoms to receive the tops of the poles for attachment to the poles to increase the height of the poles for more conveniently supporting larger models between the poles.

Briefly stated, the invention comprises an adjustable support for supporting miniature objects such as a model airplane or model boat.

Referring more particularly to the drawings, in FIG. 1 the pair of adjustable supports 20 and 20' are illustrated with their forward ends 21 and 22 shown laterally supporting a model airplane along the front and rear portions 24 and 25 of the airplane, with the rearward ends 26 and 27 of the supports attached to a flat supporting surface 28 such as a table by clamps 29 and 30. Each support 20 and 20' has a pair of posts or poles 31 and 32 with one pole mounted upright to the forward end 21 of the base support 33 of each support and with the other post mounted to the movable support 34 on each base support of each of the adjustable supports.

The base support 33 has a plurality of vertical bores 35 at spaced intervals along its length and the movable support has a bolt 37 receivable in the any one of the bores selectively for moving the adjustable or movable support 34 to a selected position upon the base support to adjust the distance between the poles 31 and 32.

The adjustable supports 20 and 20' will be used to support such things as a model airplane 23 by attaching the base supports 33 of each adjustable support 20 and 20' to the edge of a table and then placing the airplane laterally across the forward ends 21 and 22, the movable support 34 may be moved to be close to the side of the airplane opposite the post 32 where the elongated slot 36 in each movable support is above one of the spaced holes 35 and then a bolt 37 may be extended upward through that particular bore into and through the slot 36 and a washer 38 placed over the top end of the bolt and a nut 38' such as a wing nut threaded onto the bolt to lock the post 31 closely adjacent the side of the airplane opposite the post 32 on each of the adjustable supports 20 and 20'.

Rubber bands 39 and 40 may be attached over the forward ends 21 and 22 of each base support 33 and movable support 34 before the air plane has been attached to the supports 20 and 20'. After the airplane has been attached and the movable supports adjusted into position, then the other end of the rubber bands may be extended laterally over the top of the plane and around the forwardmost end 43 of each base support into a stretched position to more securely lock the portions of the plane to the supports 20 and 20'.

In using the supports 20 and 20' for supporting the hulls 44 of model boats, for example, a modification or attachment 45 and 45' will be mounted to each pair of posts 31 and 32 as illustrated in FIGS. 4 and 5. Rather than having the bottom 44' supported on the base support as the model air plane is supported, a string 46 having a knot 46' at one end will be attached in the slot 47 of one of the attachments 45 with the knot adjacent the outer edge of the attachment and the string will be extended across to the other of the attachments 45' and wedged into the slot 47 with enough slack in the string so that the bottom of the hull will rest upon the string above the base supports with the posts 31 and 32 sufficiently close to the sides of the hull that the movable support 34 may be slid in their slots 36 along the bolts 37 to a position adjacent the side of the hull with the string still supporting the hull above the base support, so that the string can snuggly support the hull above the base supports with the string following the contour of the hull to keep it snuggly in a fixed position.

In using the supports 20 and 20' for larger models where the posts 31 and 32 will have inadequate height to safely support the model therebetween, a pair of poles 48 and 48' having sockets 49 and 49' of a size to receive the posts 31 and 32 in close proximity may be attached over each of the posts 31 and 32 to extend the height of the posts to more safely support models of larger heights therebetween.

The extension posts or poles 48 and 48' are illustrated in FIG. 6.

A lateral brace 49 may be bolted across the two adjustable brace supports 20 an 20' to secure the supports against lateral movement. The lateral brace may have a plurality of hole 49' to enable the bolts with the wing nuts 50 to be used in different positions to adjust the space between the supports 20 and 20'.

It will be obvious that various changes and departures may be made to the invention without departing from the spirit and scope thereof, and accordingly, it is not intended that the invention be limited to that specifically described in the specification or as illustrated in the drawing but only as set forth in the appended claims wherein:

What is claimed is:

1. In a device for assisting in support and assembly of minature objects such as model airplanes, an apparatus comprising a table, a pair of elongated base members each having an upright post fixed at one end, means to secure the other ends of the base members to the tabke with their other ends projecting horizontally from the table in spaced relation, a slidable member for each base member, an upright post fixed to a portion of each of said slidable members, said base members each having a bolt extending upward from the base member, said slidable member having an elongated slot to receive said bolt in an adjusted position in said slot toward and away from said post on said base member, so as to engage a minature object at spaced intervals from opposite sides, means to tighten said bolts to said slidable member and base member to secure said object to said table in a manner to provide access to the object to facilitate working on the object.

2. A support apparatus for supporting minature objects during their construction comprising a table, a pair of elongated arms having one end mounted to said table and their other end projecting horizontally outward therefrom in space relation, an adjustalbe sliding member on each arm adjustable in position along the length of the arm, upright posts fixed on each arm adjacent the other ends of the arms and upright posts on the each slidable member whereby a minature object may be placed across the base members and the slidable members adjusted to engage the posts on the base members and slidable members against the object from opposite sides at spaced intervals to secure the object to the table in a manner to provide access to the object for working on the object.

3. A support apparatus according to claim 2 wherein said posts have extensions to adjust the post height to accomodate different height objects.

4. A support apparatus according to claim 3 wherein said posts have notches to extend rope means between the posts for supporting objects from beneath the objects.

* * * * *